United States Patent [19]

Vrabel

[11] 3,979,813

[45] Sept. 14, 1976

[54] SHAVER ASSEMBLY TOOL

[75] Inventor: Edward J. Vrabel, Stratford, Conn.

[73] Assignee: Sperry Rand Corporation, Bridgeport, Conn.

[22] Filed: Oct. 12, 1972

[21] Appl. No.: 297,029

[52] U.S. Cl. ..... 29/270; 81/3 R

[51] Int. Cl.[2] ..... B25B 27/00

[58] Field of Search ..... 29/200 M, 270, 272, 29/275, 278, 282; 81/3 R; 30/90; 145/46

[56] References Cited

UNITED STATES PATENTS

| | | | |
|---|---|---|---|
| 634,862 | 10/1899 | Baggett | 81/3 R |
| 2,623,279 | 12/1952 | Lewando | 30/90 X |
| 2,741,837 | 4/1956 | Breazeale | 30/90 X |
| 2,780,120 | 2/1957 | McCarley | 81/3 R X |
| 2,860,408 | 11/1958 | Woyton | 29/275 |

*Primary Examiner*—James L. Jones, Jr.
*Attorney, Agent, or Firm*—Charles R. Miranda

[57] ABSTRACT

A cutter head assembling tool for use with an electric shaver having a cutter head of the type which includes inner and outer cutters, each of which is provided with hair shearing edges, and wherein the inner cutter is insertable into the outer cutter. The tool has a body portion, a handle portion and a stop portion, and is used to facilitate inserting the inner cutter into the outer cutter without damaging the hair shearing edges. In a shaver having cutters with hair shearing teeth; when inserting the inner cutter into the outer cutter the tool is held against the inner cutter with one side of the body portion resting on the toothed wall of the inner cutter, and with the stop portion urged against an end of the inner cutter. After partial insertion, the handle portion of the tool is grasped to thrust the stop portion toward the outer cutter to insert the tool's body portion into the outer cutter along with the inner cutter. In doing so, the other side of the body portion of the tool slidably engages the toothed wall of the outer cutter, spacing the inner cutter apart from the outer cutter teeth to prevent cutter tooth damage attendant upon inserting the inner cutter into the outer cutter.

2 Claims, 16 Drawing Figures

Fig. 1.
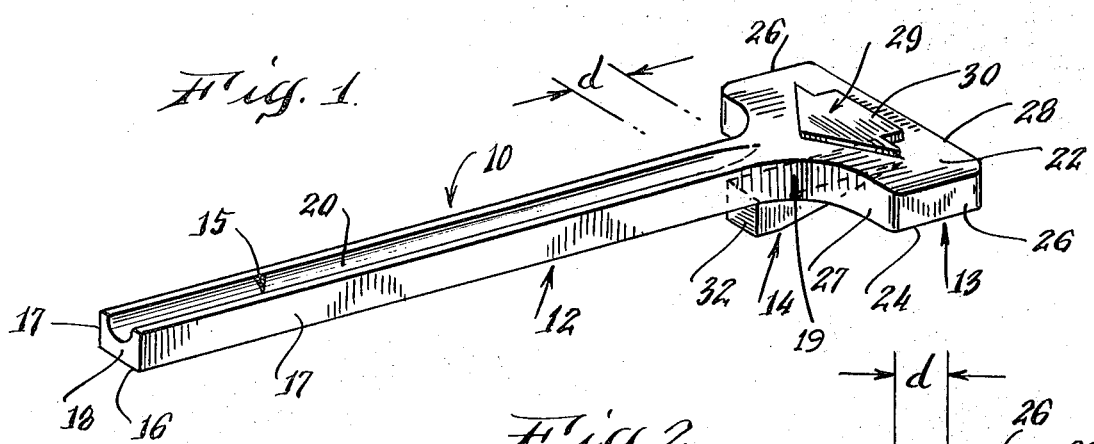
Fig. 2.
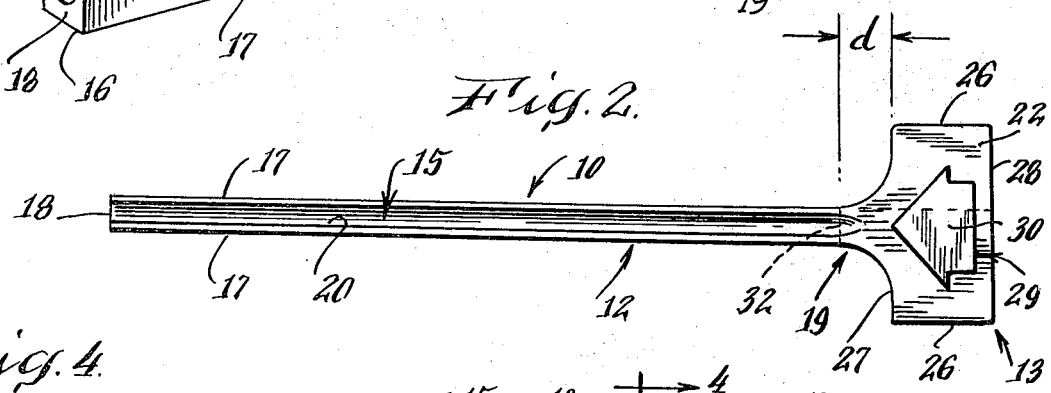
Fig. 4.
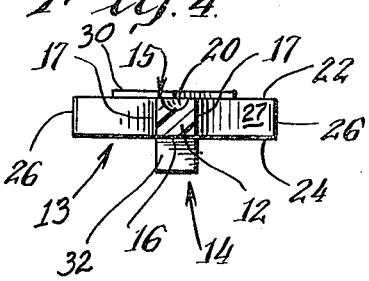
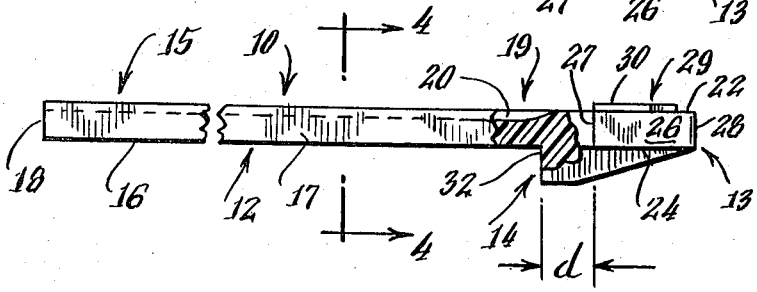
Fig. 3.
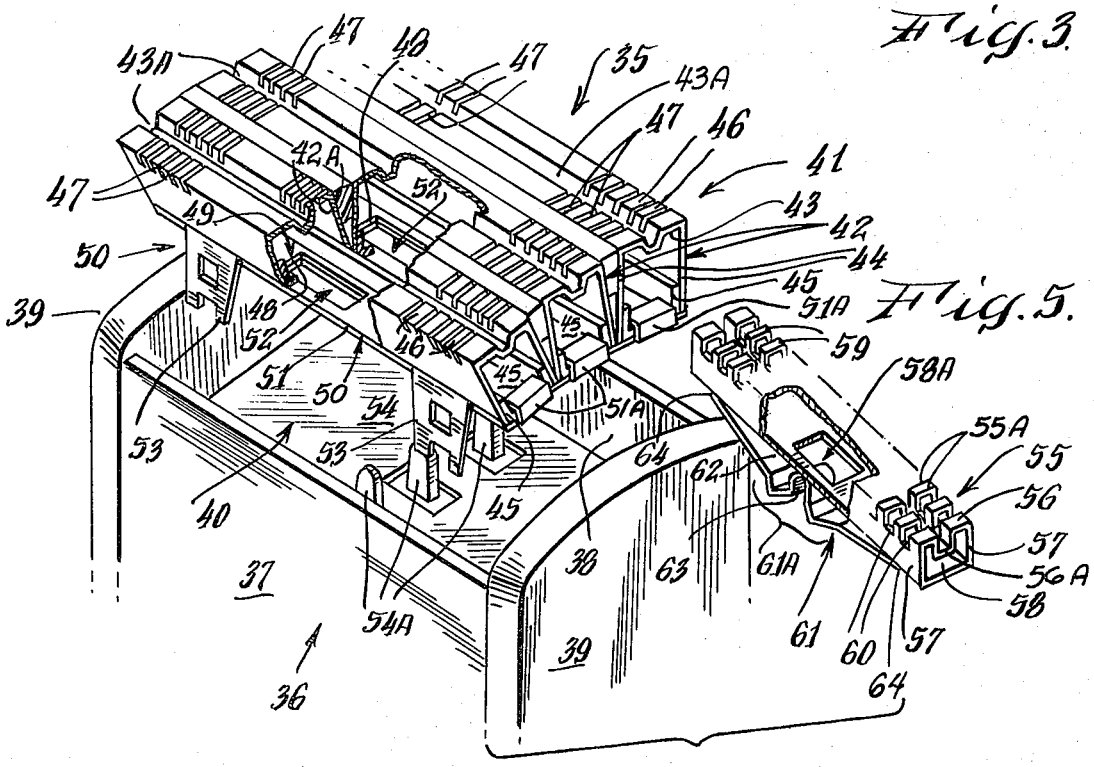
Fig. 5.

SHAVER ASSEMBLY TOOL

BACKGROUND OF THE INVENTION

This invention is concerned with a cutter head assembling tool for use with an electric dry shaver including a cutter head having inner and outer cutters respectively provided with hair shearing edges, and in which the inner cutter is removably insertable into the outer cutter. More particularly, the invention is concerned with a tool for spacing the inner cutter apart from the hair shearing teeth of the outer cutter while inserting the inner cutter into the outer cutter, to prevent cutter tooth damage attendant upon insertion of the inner cutter into the outer cutter.

In a cutter head of the type wherein the inner and outer cutters have hair shearing teeth, the cutter head includes one or more elongated outer cutters of hollow, transversely rectangular, cross-section, and a corresponding number of elongated inner cutters mounted for reciprocation within the outer cutters. Each of the outer cutters includes an upper wall, depending skirt walls and base spacer. The upper walls are each provided with a plurality of transversely extending, parallel, slots, for forming a plurality of parallel hair shearing teeth in the upper walls. And, each of the inner cutters includes an upper wall, lower wall and depending side walls, with the upper wall provided with a plurality of parallel hair shearing teeth.

Reciprocating motion is imparted to the inner cutters by a motor mounted within the shaver. To that end, each of the inner cutters is provided with a leaf spring, the ends of which are connected to the lower wall of the inner cutter. The leaf springs each include a contoured portion formed in the spring, midway between the ends of the spring, to engage a shaver motor arm. And, each of the base spacers of the respective outer cutters has an opening through which the motor arm and contoured portion of the spring protrude for engagement with one another.

The inner cutter is usually assembled within the outer cutter with the cutter head removed from the shaver. In some shavers the cutter head need only be raised to disconnect the cutter head from the shaver motor arm. To assemble the cutters, an end of the inner cutter is introduced into an end of the outer cutter. As a result of doing so, the spring connected to the inner cutter is partially compressed. Thereafter, by pushing the opposite end of the inner cutter inwardly of the outer cutter, and thus towards the opening in the base spacer of the outer cutter, the inner cutter is further inserted into the outer cutter, and the spring further compressed. The inner cutter is pushed into the outer cutter until the contoured portion of the spring is partially situated within the base spacer opening. With the contoured portion of the spring so situated, the inner cutter is positioned within the outer cutter with the hair shearing teeth of the cutters properly disposed in relation to one another for shearing hair. The spring thereafter expands within the outer cutter base spacer opening to automatically position the inner cutter within the outer cutter for engagement with the shaver motor arm. Upon mounting the cutter head on the shaver, or lowering the cutter head for connection to the motor arm, as the case may be, the spring is compressed by the shaver motor arm and may be reciprocated thereby, to reciprocate the inner cutter within the outer cutter for shearing hair.

In the course of introducing the inner cutters into the outer cutters, care must be exercised to be sure that the ends of the inner cutters do not contact the toothed walls of the outer cutters with which they are associated. The toothed walls are easily bent, pierced or otherwise damaged by exerting minimal forces thereagainst. Assuming an inner cutter has been initially introduced into an outer cutter, as the inner cutter is pushed inwardly of the outer cutter, care must be exercised to avoid cocking the inner cutter within the outer cutter with consequent damage to either the inner or outer cutter teeth. Thereafter, care must be exercised when positioning the inner cutter within the outer cutter to ensure proper alignment of the inner and outer cutter teeth, and introduction of the contoured portion of the inner cutter leaf spring into the outer cutter base spacer opening, as hereinbefore discussed. In the course of replacing inner cutters, shaver users must thus master a difficult inner cutter insertion procedure to insert and position the inner cutters within the outer cutters without damaging the hair shearing teeth.

Accordingly, an object of this invention is to provide a tool for use with an electric shaver, to facilitate inserting the inner cutters into the outer cutters.

Another object is to provide a tool for spacing the hair shearing means of an outer cutter from the inner cutter with which it is associated, as the inner cutter is inserted into the outer cutter.

Another object is to provide a tool for positioning an inner cutter within an outer cutter upon insertion of the inner cutter into the outer cutter.

A further object is to provide a tool for inserting an inner cutter into an outer cutter.

A still further object is to provide a tool for inserting and positioning an inner cutter within an outer cutter, while maintaining the hair shearing teeth of the inner cutter spaced apart from the hair shearing teeth of the outer cutter.

And another object is to provide a process which facilitates inserting and positioning an inner cutter into an outer cutter while protecting the teeth of the cutters from damage.

SUMMARY OF THE INVENTION

The invention resides in providing apparatus for use with an electric shaver, which includes outer and inner cutters having hair shearing means, such as hair shearing edges, to facilitate inserting and positioning an inner cutter into an outer cutter without damaging the hair shearing edges of the cutters.

The apparatus includes a tool with provision for spacing the hair shearing edges of the respective cutters apart from one another as the inner cutter is inserted into the outer cutter, and provision for positioning the inner cutter in a predetermined position within the outer cutter upon insertion.

To protect cutters having hair shearing teeth, the tool is preferably provided with an elongated body portion having a handle portion extending therefrom. The handle portion of the tool is grasped to insert the body portion into the outer cutter along with the inner cutter. The body portion cooperates with the inner and outer cutters to space the inner cutter apart from the hair shearing teeth of the outer cutter, as the inner cutter is inserted. To position the inner cutter within the outer cutter the tool is preferably provided with stops which are spaced apart from one another a predetermined distance. One of the stops is forced into contact with an end of the inner cutter to position the inner cutter relative to the tool, and the other stop, upon contacting the end of the outer cutter into which the inner cutter is inserted, positions the tool relative to the outer cutter. The inner cutter is properly positioned relative to the outer cutter for shearing hair when the latter stop contacts the outer cutter and the tool is thereafter withdrawn from the outer cutter.

The invention also resides in a method of facilitating the insertion of an inner cutter into an outer cutter having hair shearing edges, and includes the steps of maintaining the inner cutter spaced apart from the hair shearing edges of the outer cutter as the inner cutter is inserted into the outer cutter, and positioning the inner cutter in a predetermined position within the outer cutter.

BRIEF DESCRIPTION OF THE DRAWINGS

FIG. 1 is a perspective view of a tool according to the present invention;

FIG. 2 is a top plan view of the tool of FIG. 1;

FIG. 3 is a side elevation, partially fragmented, of the tool of FIG. 1;

FIG. 4 is a section of FIG. 3, taken substantially along the line 4—4 of FIG. 3;

FIG. 5 is an exploded perspective view of the upper end portion of an electric shaver including the cutter head thereof;

DESCRIPTION OF THE PREFERRED EMBODIMENTS

Figure 6:
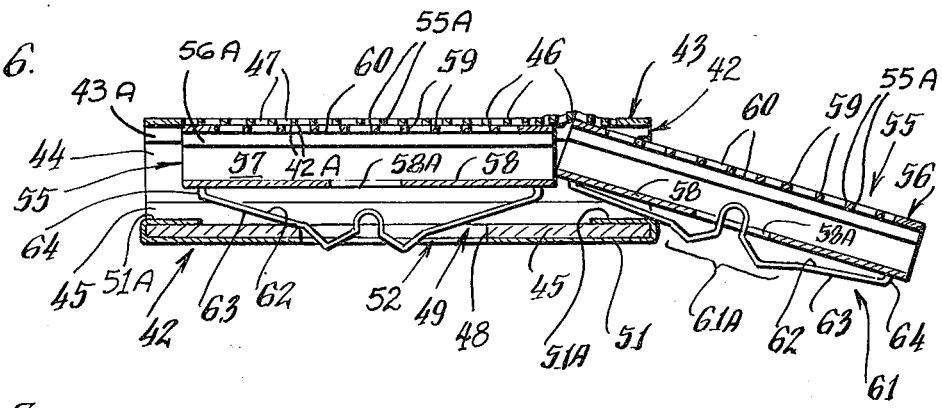
FIG. 6 is a cross-sectional view in elevation of an assembled inner and outer cutter, showing a new inner cutter being introduced into an outer cutter in accordance with the prior art.

As shown in the drawings, wherein like reference numerals designate like or corresponding parts throughout the several views, a cutter head assembling tool 10 according to the invention includes an elongated body portion 12, a handle portion 13 and a stop portion 14. The tool 10 is preferably made of, for example, a resilient material which is softer than steel, such as an organic plastic material.

As shown in FIGS. 1–4, the body portion 12 is of transversely rectangular cross-section, and has a contoured upper surface 15, a lower surface 16 and opposing side surfaces 17. The body portion 12 extends forwardly of the handle portion 13 and includes a front end surface 18. The other end of the body portion 12, generally designated by the numeral 19, merges with the handle portion 13. The upper surface 15 has an elongated recess 20 of U-shaped cross-section formed therein. The recess 20 extends rearwardly towards the handle portion 13, from the front end surface 18.

The handle portion 13 is formed integrally with the body portion 12, and extends both rearwardly and transversely from end 19 of the body portion 12. The handle portion 13, which is dimensioned to be easily manually grasped by a user, has an upper surface 22, a lower surface 24, opposing side surfaces 26, a front end surface 27 and a back end surface 28. The front end surface 27 of the handle portion 13, merges into the opposing side surfaces 17 of the body portion 12. Indicia means 29, including a forwardly pointing, arrow-shaped platform 30, elevated slightly above the upper surface 22 of the handle portion 13, is provided as an aid to inform users as to the proper usage of the tool 10.

The stop portion 14, is a ram-shaped portion depending from the handle and body portions, 12 and 13. The stop portion 14 has a forwardly oriented surface 32 which extends downwardly from the lower surface 16 of the tool's body portion 12 and is spaced a predetermined distance, *d*, forwardly of the front end surface 27 of the handle portion 13.

An upper end of an electric dry shaver 35 (FIG. 5), of the type with which the tool 10 may be used, generally includes an upper portion of a casing 36. The casing 36 includes spaced front and rear walls, respectively numbered 37 and 38, and spaced side walls 39. The walls 37–39 define a rectangularly-shaped receptacle 40 within which a cutter head 41 is located.

The cutter head 41 includes a plurality of hollow, elongated, stationary, outer cutters 42, of transversely rectangular cross-section. Each of the outer cutters 42 has an upper wall portion 43, spaced depending skirt portions 44 and an elongated base spacer 45 of U-shaped cross-section. The upper wall portion 43 each have hair shearing edges 42A formed by two rows of a plurality of spaced, parallel, transversely extending, hair shearing teeth 46. The teeth 46 are formed by two rows of slots 47 spaced from one another by an inwardly projecting, substantially U-shaped channel portion 43A in the upper wall portion 43 of the outer cutter 42. The base spacers 45 are located between the lower ends of the skirt portions 44 of the respective outer cutters 42, and fixedly connected to the skirt portions 44 by means well-known in the art. Each of the base spacers 45 has an elongated rectangularly-shaped inner edge 48, forming an opening 49 in the base spacer 45.

The outer cutters 42 are mounted alongside and parallel to one another on a cutter head mounting frame 50. The frame 50 includes an elongated, rectangular, base plate 51, having a plurality of spaced, parallel, openings 52 formed therein, and a plurality depending leg portions 53. The outer cutter base spacer openings 49 are respectively aligned in registry with one of the frame's base plate openings 52, and the base spacers 45 fixedly connected to the base plate 51 of the frame 50, by means well-known in the art. For example, the base plate 51 may be provided with tabs 51A, which are folded over and spot welded in place to the ends of the outer cutter base spacers 45. The leg portions 53 may be removably fastened, by known means (not shown), to a motor housing 54 within the casing 36.

The cutter head 41 also includes a plurality of hollow, elongated, inner cutters 55, of transversely rectangular cross-section. Each of the inner cutters 55 has an upper wall portion 56, spaced depending side wall portions 57 and an elongated lower wall portion 58, the lower wall portion 58 having an opening 58A formed therein. The upper wall portions 56 each have hair shearing edges 55A formed by two rows of plurality of spaced, parallel, transversely-oriented, hair shearing teeth 59. The teeth 59 are formed by two rows of slots 60 separated from one another by a recessed U-shaped channel portion 56A in the upper wall portion 56 of the inner cutter 55. Channel portion 56A has a configuration which is substantially complementary to the configuration of the outer cutter channel portion 43A.

Figure 9:
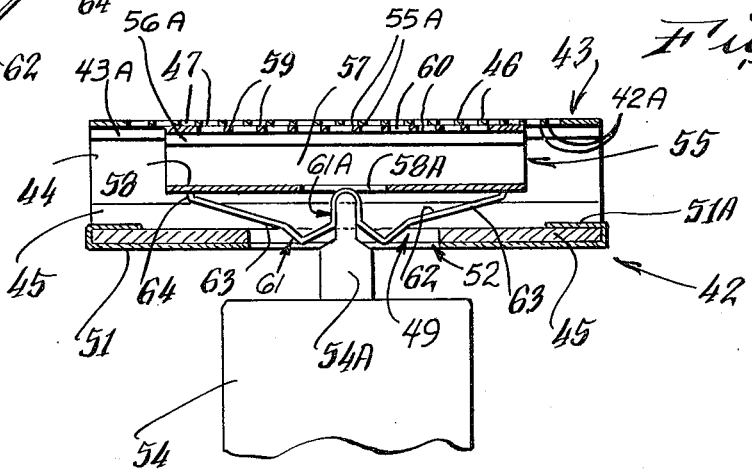
FIG. 9 is a cross-sectional view in elevation of an assembled inner and outer cutter showing the inner cutter connected to a shaver motor arm via a spring.

Each of the inner cutters 55 is reciprocated within one of the outer cutters 41 by means of a spring 61 driven by a motor arm 54A of the shaver motor (not shown). Each of the springs 61 is an elongated leaf spring having an upper surface 62, lower surface 63 and opposed ends 64. Each of the springs 61 also has a contoured portion 61A, formed in the spring 61 midway between the ends 64 thereof. The ends 64 of a given spring 61 are connected by known means (not shown) to the lower wall portion 58 of a given inner cutter 55 and carried thereby. Assuming the inner cutters 55 are inserted within the outer cutters 42, and the cutter head 41 (FIG. 5) is mounted within the shaver casing 36, as hereinbefore described, the springs 61 carried by the inner cutters 55 are each compressed (FIG. 9) towards the inner cutter lower wall portions 58 by one of the motor arms 54A. The motor arms 54A extend upwardly through openings, 49 and 52, and engage the contoured mid-portions 61A of the springs 61. Reciprocating motion of the motor arms 54A is transmitted to the inner cutters 55 via springs 61. The cutter channel portions 43A and 56A guide movement of the inner cutters 55 within the outer cutters 42.

In accordance with prior art practice, before replacing old inner cutters 55, for example, those that are worn, damaged or otherwise in need of replacement, the cutter head 41 (FIG. 5) is either raised above the motor arms 54A or removed from the shaver casing 36. In the above described shaver 35 (FIG. 5), the cutter head 41 is removed. Whereupon, an end of a new inner cutter 55 (FIG. 6) may be introduced into an end of each of the outer cutters 42 having an old inner cutter 55 mounted therein. In the process of doing so, the end of the new inner cutter 55 may be easily rammed into the outer cutter's upper, toothed, wall 43. The consequent damage to the outer cutter wall 43, however slight, seriously impairs the performance of the shaver 35.

Figure 7:
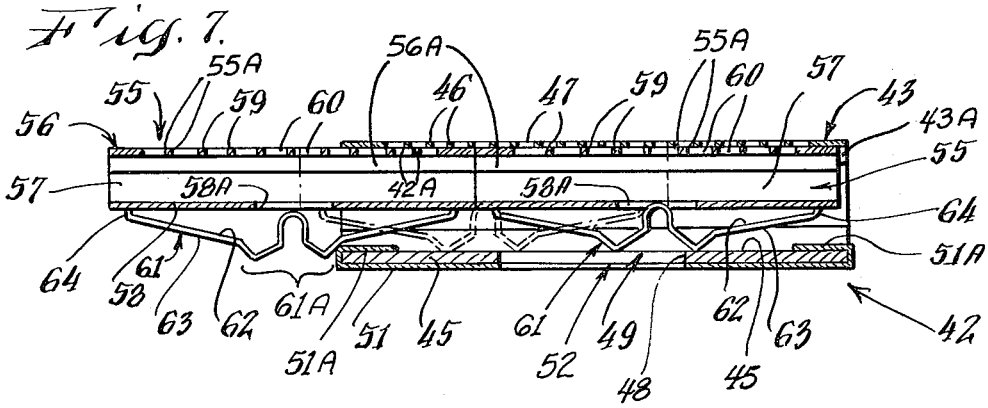
FIG. 7 is a cross-sectional view in elevation of an old inner cutter and new inner cutter, being moved within an outer cutter in accordance with the prior art.

As shown in FIG. 7, assuming the new inner cutter 55 is introduced with mishap, as the new inner cutter 55 is inserted into one end of the outer cutter 42, the old inner cutter 55 is pushed toward the opposite end of the outer cutter 42 by the new inner cutter 55. As shown in dashed lines in FIG. 7, the old spring 61 is initially compressed between the outer cutter's base spacer 45 and the old inner cutter's lower wall portions 58. The old spring's contoured mid-portion 61A is thus caused to extend partially into the old inner cutter's base spacer opening 58A. Thereafter, as shown in solid lines in FIG. 7, the old spring 61 is further compressed by the adjacent base plate tab 51A. When the old inner cutter spring 61 is moved partially outside of the outer cutter 42, the old spring's mid-portion 61A is disposed almost completely outside of the outer cutter 42, allowing the spring 61 to expand against the adjacent base plate tab 51A. Due to the old spring 61 thus expanding, the old inner cutter 55 is ejected (FIG. 8) from the outer cutter 42. As the old inner cutter 55 is being pushed out of the outer cutter 42 (FIG. 7), the new inner cutter spring 61 is first compressed toward the new inner cutter's lower wall portion 58, by the base plate tab 51A located adjacent to the new spring 61, and then compressed by the outer cutter's base spacer 45. As the new spring 61 is so compressed the new inner cutter 55 is forced upwardly against the toothed wall 43 of the outer cutter 42. The user must thus be careful when forcing the new inner cutter 55 into the outer cutter 42, to avoid pushing the new inner cutter 55 forcefully against the outer cutter 42, to avoid consequent damage to either the inner or outer cutters, 55 and 42.

Figure 8:
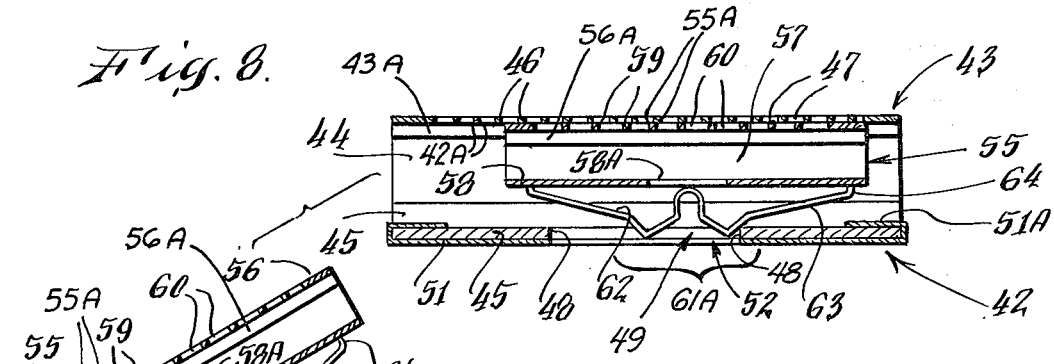
FIG. 8 is a cross-sectional view in elevation of an old inner cutter ejected from an outer cutter, and a new inner cutter positioned within the outer cutter.
Figure 8:
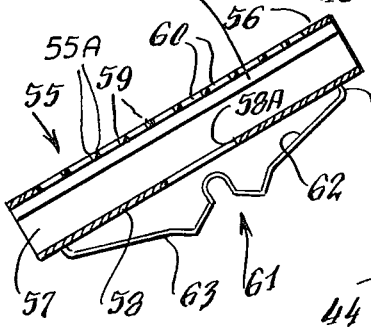

As shown in FIG. 8, the new inner cutter 55 is pushed into the outer cutter 42 until the new spring's contoured mid-portion 61A is almost completely disposed within the outer cutter and base plate openings, 49 and 52. When the new spring's mid-portion 61A is thus situated, the hair shearing teeth, 46 and 59, are slidably disposed in hair shearing relation with respect to one another, and the new spring's contoured mid-portion 61A expands against the base plate opening's inner edge 48 to carry the new inner cutter 55 further inwardly (FIG. 9) of the outer cutter 42. When the new spring 61 has expanded, the new spring's contoured mid-portion 61A may be engaged by the shaver motor arm 54A upon lowering the cutter head 41 (FIG. 5) into the shaver casing receptacle 40.

After new inner cutters 55 have been inserted, as necessary, into each of the outer cutters 42, the cutter head 41 is mounted within the shaver casing receptacle 40, as hereinbefore described. Whereupon a motor arm 54A engages each of the new spring's contoured mid-portions 61A to resiliently bias the new inner cutters 55 upwardly (FIG. 9) against the outer cutters 42 for shearing hair.

This invention is directed to providing a tool, such as the tool 10 (FIGS. 1–4), to facilitate inserting and positioning new inner cutters 55 (FIG. 5) within the outer cutters 42 without damaging the hair shearing teeth, 59 and 46. The tool 10, is used to maintain the new inner cutter 55 spaced a predetermined distance apart from shearing teeth 46 as the new inner cutter 55 is inserted. As in the prior art, the shaver cutter head 41 is either raised above or otherwise disconnected from the motor arms 54A prior to replacing the old inner cutters 55.

Figure 10:
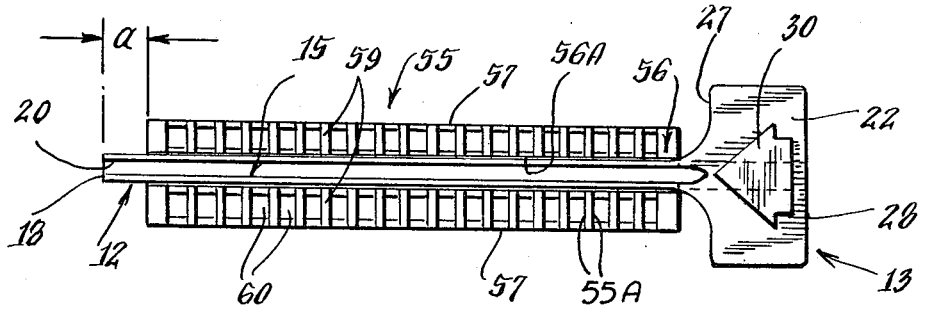
FIG. 10 is a top plan view of a tool, according to the invention, as used in connection with an inner cutter of an electric shaver.
Figure 11:
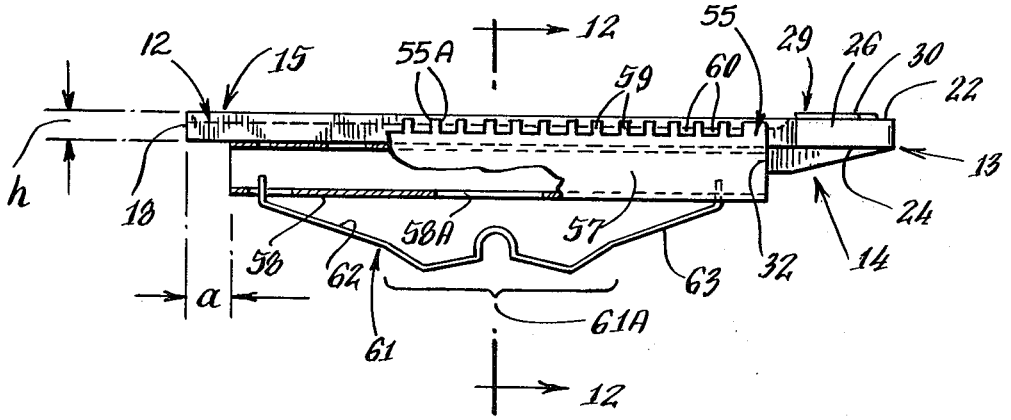
FIG. 11 is a side elevation of the tool and inner cutter of FIG. 10.
Figure 12:
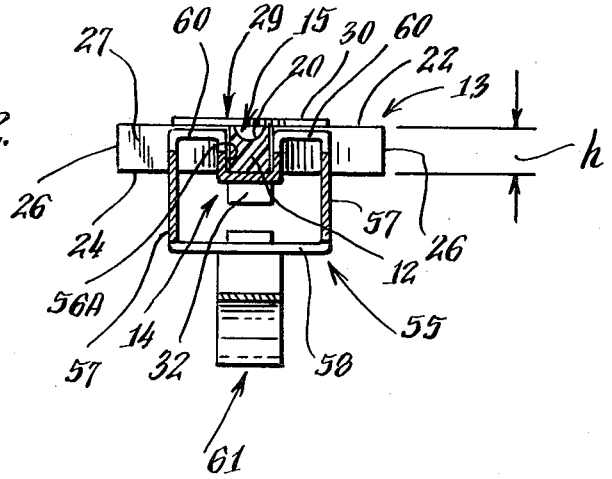
FIG. 12 is a section of FIG. 11, taken substantially along the line 12—12 of FIG. 11.
Figure 13:
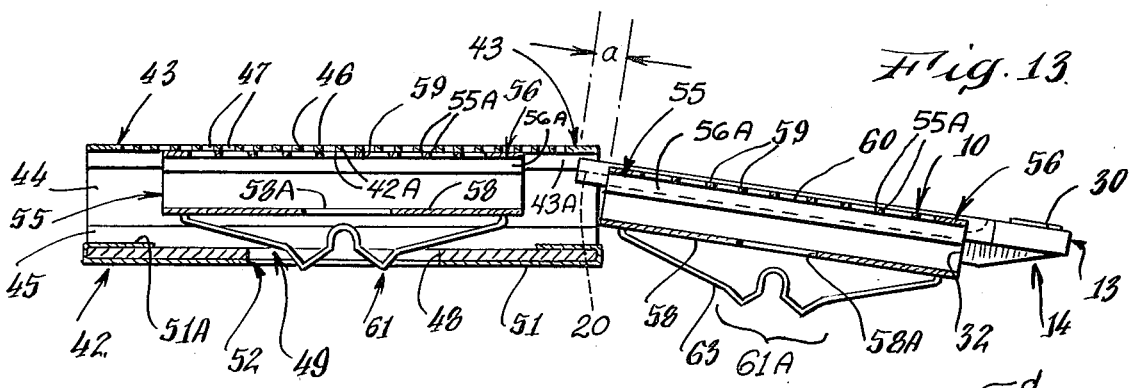
FIG. 13 is a cross-sectional view in elevation of an assembled inner and outer cutter, and a new inner cutter about to be introduced into the outer cutter by means of a tool according to the invention.

As shown in FIGS. 10–12, the tool's body portion 12 is dimensioned to be received within the U-shaped channel 56A of the toothed wall portion 56 of a new inner cutter 55, to aid in holding the tool's body portion 12 in place on the new inner cutter 55. As shown in FIG. 11, the overall height $h$ of the body portion 12 is made greater than the depth of inner cutter channel 56A, to provide material for forming the recess 20 in the body portion 12. Portions of the recess 20 are situated both above and below the level of the adjacent rows of inner cutter teeth 59 (FIG. 12). When placing the body portion 12 on the new inner cutter 55, the handle portion 13 (FIG. 11) of the tool 10 is manually grasped to push the tool forwardly until the tool's stop surface 32 is brought into contact with the adjacent end of the new inner cutter 55. The longitudinal length of the tool's body portion 12, is dimensioned such that when surface 32 contacts one end of the inner cutter 55, the front end portion *a* of the body portion 12 extends beyond the other end of the inner cutter 55, the latter end of the inner cutter 55 being the end thereof that is introduced into the outer cutter 42 as shown in FIG. 13.

Figure 14:
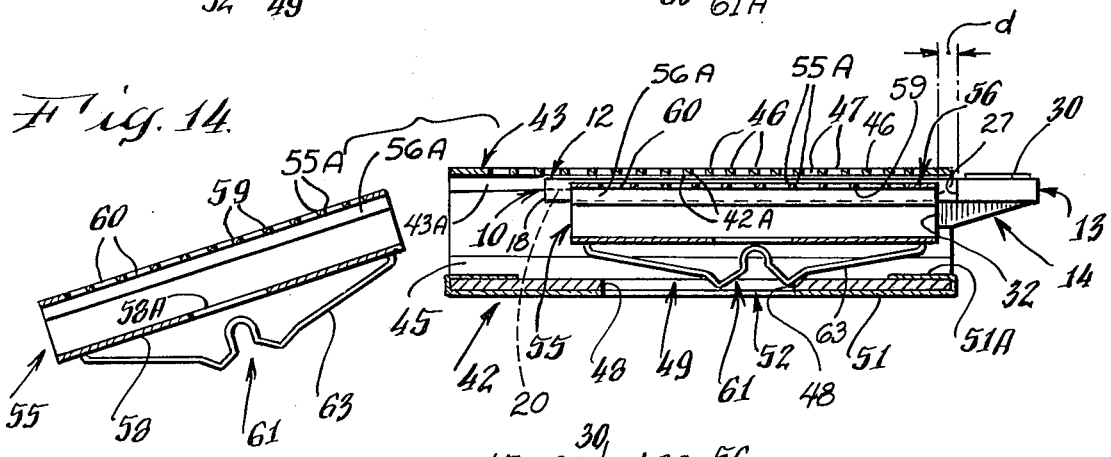
FIG. 14 is a cross-sectional view in elevation of an old inner cutter ejected from an outer cutter, and a new inner cutter being positioned within the outer cutter by means of a tool according to the invention.
Figure 15:
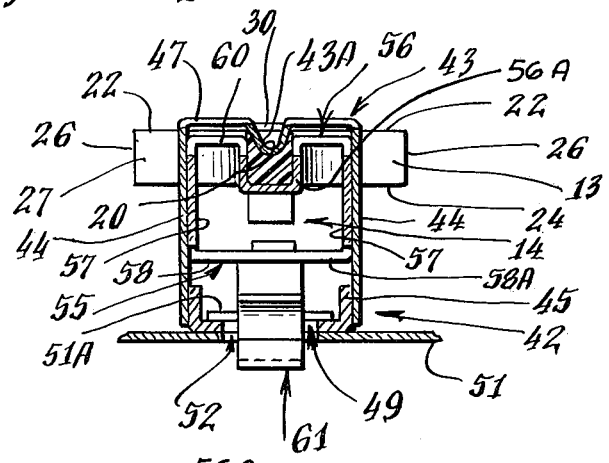
FIG. 15 is a section of FIG. 14 taken substantially along the line 15—15 of FIG. 14.

Upon introduction of the end of the new inner cutter 55 into the outer cutter 42, the tool's end portion *a* contacts the underside of outer cutter channel 43A, thereby spacing the adjacent end of the new inner cutter 55 apart from the outer cutter's toothed wall 43, to prevent attendant damage to the toothed wall 43. Upon insertion of the tool 10, the tool's front end surface 18 contacts the end of the old inner cutter 55. As shown in FIG. 15, the tool's contoured upper surface recess 20 is preferably dimensioned to cradle therein the outer cutter's guide channel portion. After partially inserting the tool's body portion 12 and the new inner cutter 55, into the outer cutter 42, the tool's handle portion 13 (FIG. 14) may be manually grasped to push the tool 10, and thus the old and new inner cutters 55, forwardly. The tool's contoured upper surface recess 20 (FIG. 15) contacts the outer cutter's toothed wall channel 43A, and the body portion 12 spaces the inner cutter 55 a predetermined distance apart from the outer cutter's toothed wall 43. The tool's body portion 12 and cutter channels 43A and 56A cooperate to guide the new inner cutter 55 into the outer cutter 55. The body portion 12 constrains movement of the inner cutter 55 to its normal path of relative movement within the outer cutter 42. As the tool 10 (FIG. 14) is moved forwardly, the recess 20 prevents transverse movement of the inner cutter 55 within the outer cutter 42, and the tool's front end surface 18 pushes the old inner cutter 55 out of the outer cutter 42. Concurrently, the tool's stop surface 32 rams the new inner cutter 55 forwardly within the outer cutter. As the spring 61 of the new inner cutter 42 is compressed, although the new inner cutter 55 tends to be forced upwardly towards the outer cutter's toothed wall portion 43, the tool's body portion 12 protects the toothed wall portion 43 from damage. The tool 10 and the outer cutter 42 longitudinally slidably engage one another as the new inner cutter 55 is inserted. The tool's body portion 12, and more particularly, the bottom of recess 20 thereof, cooperates with the new inner cutter 55 and outer cutter 42 to maintain the new inner cutter 55 spaced apart from the outer cutter's toothed wall 43 as the new inner cutter 55 is inserted.

Insertion of the new inner cutter 55 by means of the tool 10 proceeds until forward motion of the tool is stopped due to the tool's front end surface 27 (FIG. 14) contacting the adjacent end of the outer cutter 42, i.e., a stationary portion of the shaver cutter head 41 (FIG. 5). Preferably the distance *d* (FIG. 14) is predetermined to be sure that when the handle portion's surface 27 stops forward movement of the tool 10, the new inner cutter 55 is positioned within the outer cutter 42 such that the inner and outer cutter teeth, 59 and 46, will slidably engage one another for shearing hair after removal of the tool. Such positioning is achieved by choosing the distance *d* to be sure that the spring's contoured midportion 61A, and particularly the spring's lower surface 63, engages the base plate opening's inner edge 48, whereupon the spring 61 ordinarily expands against edge 48 to slide the new inner cutter 55 forwardly against the tool's lower surface 16. When the new inner cutter 55 thus moves further forwardly into the outer cutter 42 the spring's contoured mid-portion 61A is completely disposed within openings 49 and 52, whereat the spring's contoured mid-portion 61A (FIG. 9) is located for engagement by the shaver motor arm 54A. The tool 10 is then slidably withdrawn from between the cutters 42 and 55, to permit cutter tooth engagement.

In the event that the spring 61 of the new inner cutter 55 does not expand to slide the inner cutter 55 further inwardly of the outer cutter 42 before withdrawal of the tool 10 (FIG. 14), the tool 10 may be withdrawn without inadvertently withdrawing the new inner cutter 55, since the force exerted by the spring's lower surface 63 against the outer cutter opening's inner edge 48 is greater than the frictional forces exerted on the tool's body portion 12 by the inner and outer cutters, 42 and 55. In this instance, upon withdrawal of the tool 10 the spring 61 will then further expand and carry the new inner cutter 55 forwardly into the outer cutter 42 as hereinbefore described.

After withdrawing the tool 10 other old inner cutters 55 may be replaced by new inner cutters 55, using the tool 10 in the same manner, and the cutter head 41 (FIG. 5) mounted within the shaver casing 36 as hereinbefore described. When the cutter head 41 is so mounted, the shaver motor arms 54A engage the new spring's contoured mid-portions 61A (FIG. 9), and compress the new springs 61 upwardly to bias the new inner cutters 55 against the outer cutters 42 for shearing hair.

Figure 16:
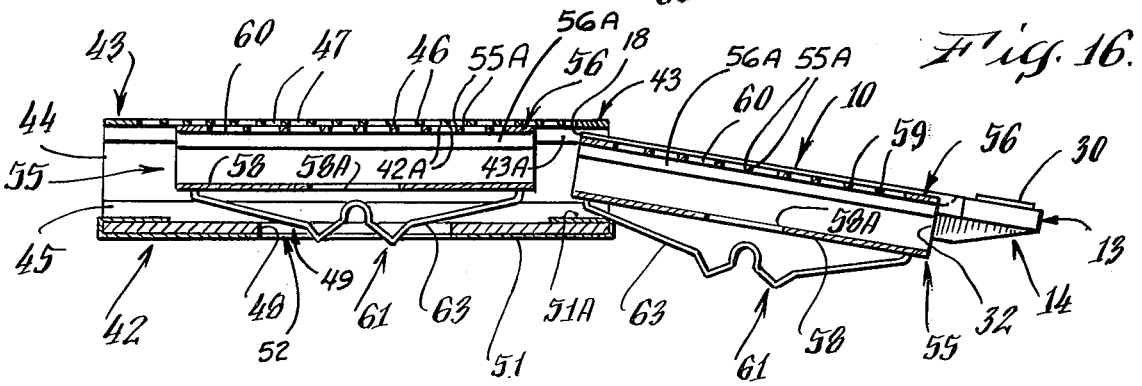
FIG. 16 is a cross-sectional view in elevation of an assembled inner and outer cutter, and a new inner cutter being introduced into the outer cutter by means of another embodiment of the tool according to the invention.

As shown in FIG. 16, without departing from the spirit and scope of the invention, the longitudinal length of the tool's body portion 12 may be shortened as compared to the body portion 12 of the tool 10 hereinbefore described. In this embodiment the tool's body portion 12 does not extend beyond an end of the new inner cutter 55 when the tool's stop portion 14 is pushed against the other end of the new inner cutter 55. As a consequence, when using the tool 10 of FIG. 16 for replacing inner cutters 55, the end of the new inner cutter 55, rather than the tool's front end surface 18, contacts the old inner cutter 55. The old inner cutter 55 is thus moved forwardly within and out of the outer cutter 42 in accordance with prior art practice. Otherwise, the construction and use of the tool 10 of FIG. 16 is in all respects the same as the construction and use of the tool 10 of FIG. 13. As shown in FIG. 16, when the new inner cutter 55 and tool 10 are inserted into the outer cutter 42 the tool's contoured upper surface 15 still spaces the new inner cutter 55 apart from the outer cutter's toothed wall 43 to prevent the outer cutter teeth 46 from being damaged by the new inner cutter 55.

In accordance with the objects of the invention there has been described a tool to facilitate assembling the cutter head of an electric dry shaver. The tool includes means for maintaining the inner cutter spaced apart from the hair shearing teeth of the outer cutter as the inner cutter is inserted into the outer cutter, to prevent attendant damage to the cutter teeth. The tool is dimensioned to space the hair shearing teeth, and thus the edges thereof, apart from one another a predetermined distance. Preferably, the tool cooperates with surfaces of the cutters which are not provided with hair shearing edges, to ensure insertion of the inner cutter within the outer cutter without damaging the shearing edges. And, the tool includes means for guiding movement of the inner cutter in a predetermined path within the outer cutter, and means for positioning the inner cutter in a predetermined position within the outer cutter, whereat the hair shearing teeth of the inner cutter are disposed in hair shearing relation with those of the outer cutter upon withdrawal of the tool from the outer cutter.

Inasmuch as certain changes may be made in the above described invention without departing from the spirit and scope thereof, it is intended that all matter contained in the above description or shown in the accompanying drawings shall be interpreted in an illustrative rather than limiting sense. And, it is intended that the following claims be interpreted to cover all the generic and specific features of the invention herein described.

I claim:

1. An assembly tool for assembling an inner cutter to an outer cutter of an electric dry shaver wherein the inner cutter is spring biased against the outer cutter to maintain the teeth of the cutters in hair shearing contact, the tool comprising, a. a body portion which is adapted to seat on one of said cutters and engage the other cutter to space all of the teeth of each cutter from each other during assembly of the cutters to prevent damaging contact therebetween, and b. a handle portion for manipulating the body portion in the assembling of the inner cutter and the outer cutter, said handle portion having a first shoulder which engages the inner cutter to facilitate movement of the inner cutter into the outer cutter, and having a second shoulder spaced from said first shoulder which engages the outer cutter to permit the inner cutter to move a limited distance within the outer cutter.

2. An assembly tool for assembling an elongated channeled inner cutter within an elongated channeled outer cutter wherein the channel of the outer cutter fits within the channel of the inner cutter and wherein the inner cutter is spring biased against the outer cutter to maintain the teeth of the cutters in hair shearing contact, the tool comprising, a. an elongated body portion which has a recess therein and is contoured to seat the channel of the inner cutter therein and to engage the channel of the outer cutter when the cutters are assembled, and b. a handle portion for manipulating the body portion in the assembling of the inner cutter and of the outer cutter, said handle portion being provided at one end of the body portion and having a first shoulder engaging the inner cutter in the usage of the tool, and a second shoulder spaced from the first shoulder in a direction further away from the body portion, said second shoulder being adapted for engagement with the outer cutter upon assembly of the cutters to limit movement of the inner cutter a predetermined distance within the outer cutter.

* * * * *